US005730388A

United States Patent [19]

Alder et al.

[11] Patent Number: 5,730,388

[45] Date of Patent: Mar. 24, 1998

[54] WARP BEAMER WITH SERVICE STEP

[75] Inventors: Günter Alder, Viersen; Joachim Beckers, Monchengladbach, both of Germany

[73] Assignee: Sucker-Muller-Hacoba GmbH & Co., Monchengladbach, Germany

[21] Appl. No.: 730,957

[22] Filed: Oct. 16, 1996

[30] Foreign Application Priority Data

Oct. 17, 1995 [DE] Germany ..... 295 16 393 U

[51] Int. Cl.[6] ..... B65H 18/08; B65H 26/00

[52] U.S. Cl. ..... 242/534; 28/190; 139/304; 242/899; 182/88; 182/91

[58] Field of Search ..... 242/534, 899; 182/88, 91; 280/166; 139/1 R, 304; 28/190, 197

[56] References Cited

U.S. PATENT DOCUMENTS

| | | | |
|---|---|---|---|
| 1,857,649 | 5/1932 | Leonard | 28/197 |
| 2,627,831 | 2/1953 | Robinson et al. | 182/91 |
| 3,463,509 | 8/1969 | Schiffner | 280/166 |
| 3,908,794 | 9/1975 | Stone | 182/91 |
| 4,110,673 | 8/1978 | Nagy et al. | 280/166 |
| 4,630,431 | 12/1986 | Schlueter et al. | 182/91 |
| 4,948,169 | 8/1990 | Amundson | 182/88 |

FOREIGN PATENT DOCUMENTS 40 14358 A1 11/1990 Germany .

*Primary Examiner*—John M. Jillions
*Attorney, Agent, or Firm*—Herbert Dubno; Andrew Wilford

[57] ABSTRACT

A warp beamer having a frame supported on the floor and a horizontal warp beam rotatable on the frame has a step assembly provided with a step displaceable between a lower position supported directly on the floor and an upper position spaced well above the floor and of the warp beam. A motor connected between the step and the frame displaces the step between its positions. The step rides on a vertical guide on the frame and a lever assembly pivots the step between a horizontal position in the lower position and a generally vertical position in the upper position.

20 Claims, 5 Drawing Sheets

13
42
47
45
41
46
53
CONTROLLER
17
18
43
44
15
12
16
21
34
10'
10
33
12A
14
M
48
31
11
32

WARP BEAMER WITH SERVICE STEP

FIELD OF THE INVENTION

The present invention relates to a warp beamer. More particularly this invention concerns an apparatus for winding a warp on a warp beam and provided with a full-length step for the operator of the machine.

BACKGROUND OF THE INVENTION

Normally a warp beamer has a drive system for rotating a warp beam about a horizontal axis. The warp formed by a multiplicity of parallel and coplanar filaments extends from a creel through guides to a warp comb normally above the warp beam, and thence the warp travels around a deflector roller to the warp beam. As the beam rotates it winds up the warp, typically into a large roll that may be over 1 m in diameter so that the overall machine may be well over 1.5 m high.

During initial setup it is necessary for the machine operator to verify that the warp is properly engaged in the comb, and during operation it is necessary for this operator to monitor machine operation, checking that the warp continues to run true. This work cannot be done by a person standing on the ground.

As described in German patent document 4,014,358 of J. Iten et al it is standard to provide the warp beamer with a full length step that extends parallel to the rotation axis of the warp beam and that supports a machine operator who must work on something at the top of this fairly large machine. The step is made so that it can be recessed in the floor when not in use so that, when the warp beam is complete, it can be moved out of the machine through the area normally occupied by the step. Without the step the operator could not reach the top of the machine. Nonetheless the full warp beam and an empty warp-beam core must normally be transported through front of the machine, so any step has to be moved out of the way for loading and unloading the machine.

While mounting the step as proposed by Iten that it can move from a lower position flush with the surrounding floor and an upper position well above the floor level has certain advantages, it is a complex and cumbersome arrangement. It cannot be supplied with the warp beamer and in fact requires special construction of the site for the warp beamer, with a recess in the floor for accommodating the liftable step.

OBJECTS OF THE INVENTION

It is therefore an object of the present invention to provide an improved warp beamer with a service step that can be moved out of the way when necessary.

Another object is the provision of such an improved warp beamer with a service step that can be moved out of the way when necessary which overcomes the above-given disadvantages, that is which is of simple construction so that it can be built right into the warp beamer.

SUMMARY OF THE INVENTION

A warp beamer having a frame supported on the floor and a horizontal warp beam rotatable on the frame has according to the invention a step assembly provided with a step displaceable between a lower position supported directly on the floor and an upper position spaced well above the floor and of the warp beam. A motor connected between the step and the frame displaces the step between its positions.

Thus when the step is not in use it is pivoted up into a position above the path a full warp beam takes when it is removed from the machine and the path followed by an empty beam that is being moved into the machine. The step assembly is integrated with and built right onto the warp beamer so that no special site preparation is necessary. In fact according to the invention the drive that rotates the warp beam about a horizontal axis is operated by a controller that automatically moves the step into the upper position when the drive means stops rotating the warp beam. Thus the operation of the step can be wholly automatic.

According to the invention a vertical guide is provided on the frame in which the step rides and a lever assembly pivots the step between a horizontal position in the lower position and a generally vertical position in the upper position. Thus not only does the step move up and out of the way, but pivots back so that it presents no hindrance to operators working on the machine. The guide can be formed as a slot in a plate secured to the machine frame.

The frame has a pair of ends flanking the warp beam and each provided with at least one such guide in which the step rides. At least one flexible element has one end operatively connected to the motor and an opposite end connected to the step. A horizontally elongated roller driven by the motor and above the warp beam is attached to the one end of the element. The element is a flexible sheet extending generally a full length of the roller and warp beam. Thus this element does double duty, acting as the connection between the step and the motor and also as a shield for the beamer during operation of the machine.

The frame is formed with at least two such guides and the step has respective followers engaged in the guides. The lever assembly includes a lever fixed to the step and carrying both of the followers. One of the guides extends at least partially at an acute angle to the other of the guides and is responsible for the pivoting movement of the step as it moves vertically. More particularly the one guide crosses the other guide and the other guide is substantially straight and vertical. More specifically the one guide has a straight and vertical end portion to one side of the other guide, an angled portion extending across the other guide, another straight and vertical portion to the other side of the other guide, and an angled end portion to the other side of the other guide. The last-mentioned angled portion ensures that the step can be tipped through more than 90° to lie completely out of the way in the upper position.

The guides are both grooves and the other guide is substantially deeper than the one guide so as to prevent the follower of the deeper guide groove from accidentally getting into the shallower guide groove. A gate is provided for closing the other guide after movement of the respective follower vertically up past the one guide. This gate is a two arm lever pivoted adjacent the other guide and having a surface positionable across a mouth where the other guide opens into the one guide. The gate lever is engageable with the follower of the other guide.

The step in accordance with this invention is provided with feet engageable in an extended position with the floor in the lower position and foldable flat in a stowed position against the seat in the Upper position. The feet are pivotal on the step and provided with lever means for automatically displacing them between the extended and stowed positions on movement of the step between the lower and upper positions. The lever means includes interlinked levers fixed to the feet and an actuating lever connected to one of the feet. One of the interlinked levers is fixed to one of the feet and has a follower riding in the guide. In addition one of the interlinked levers is formed with a slot and the other of the interlinked levers has a follower pin slidable along the slot. This forms a sort of parallelogrammatic linkage that automatically stows the legs that support the step when the step is moved into the upper out-of-use position.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
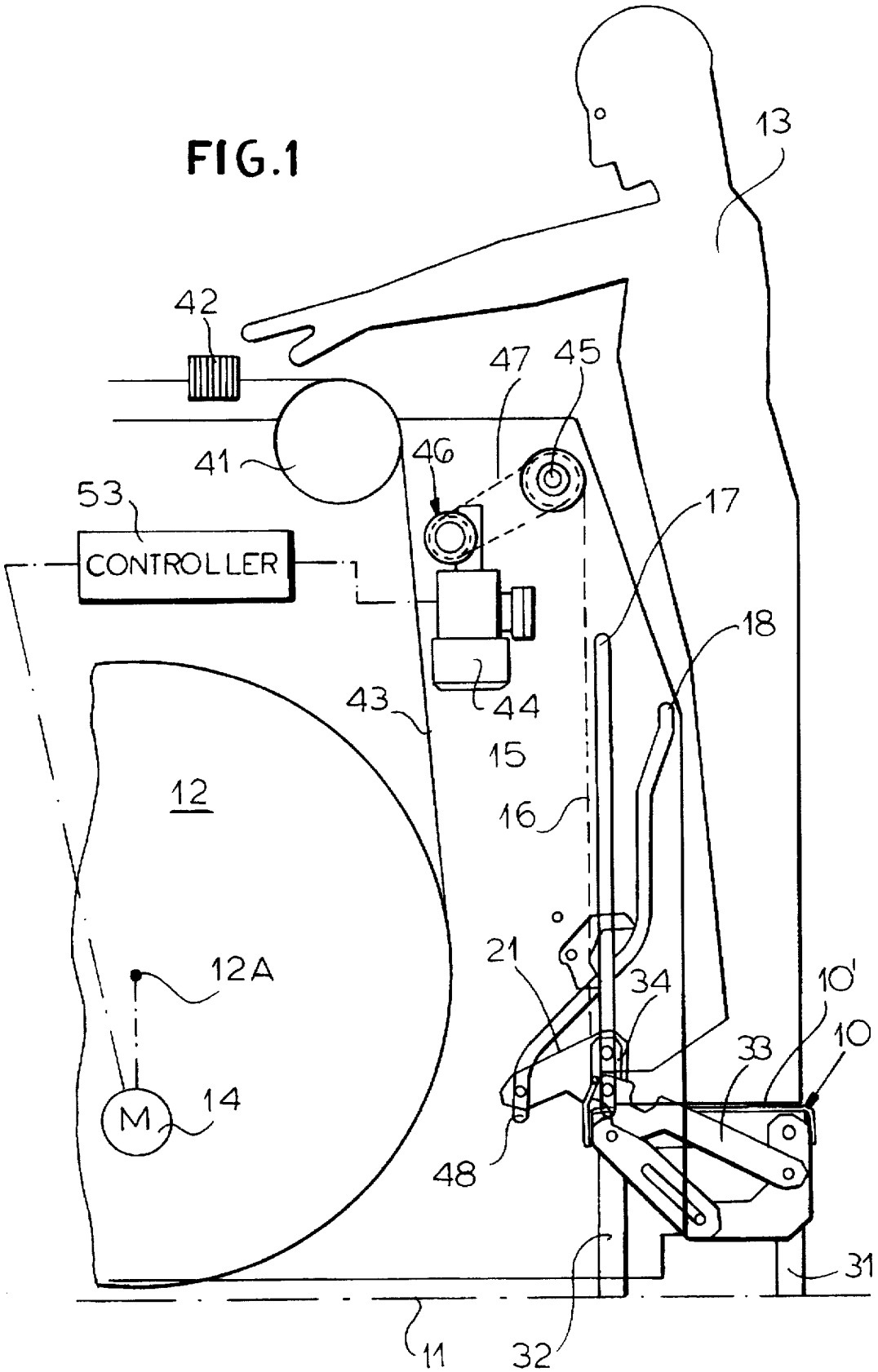
FIG. 1 is a small-scale and partly schematic view of the warp beamer according to the invention.
Figure 2:
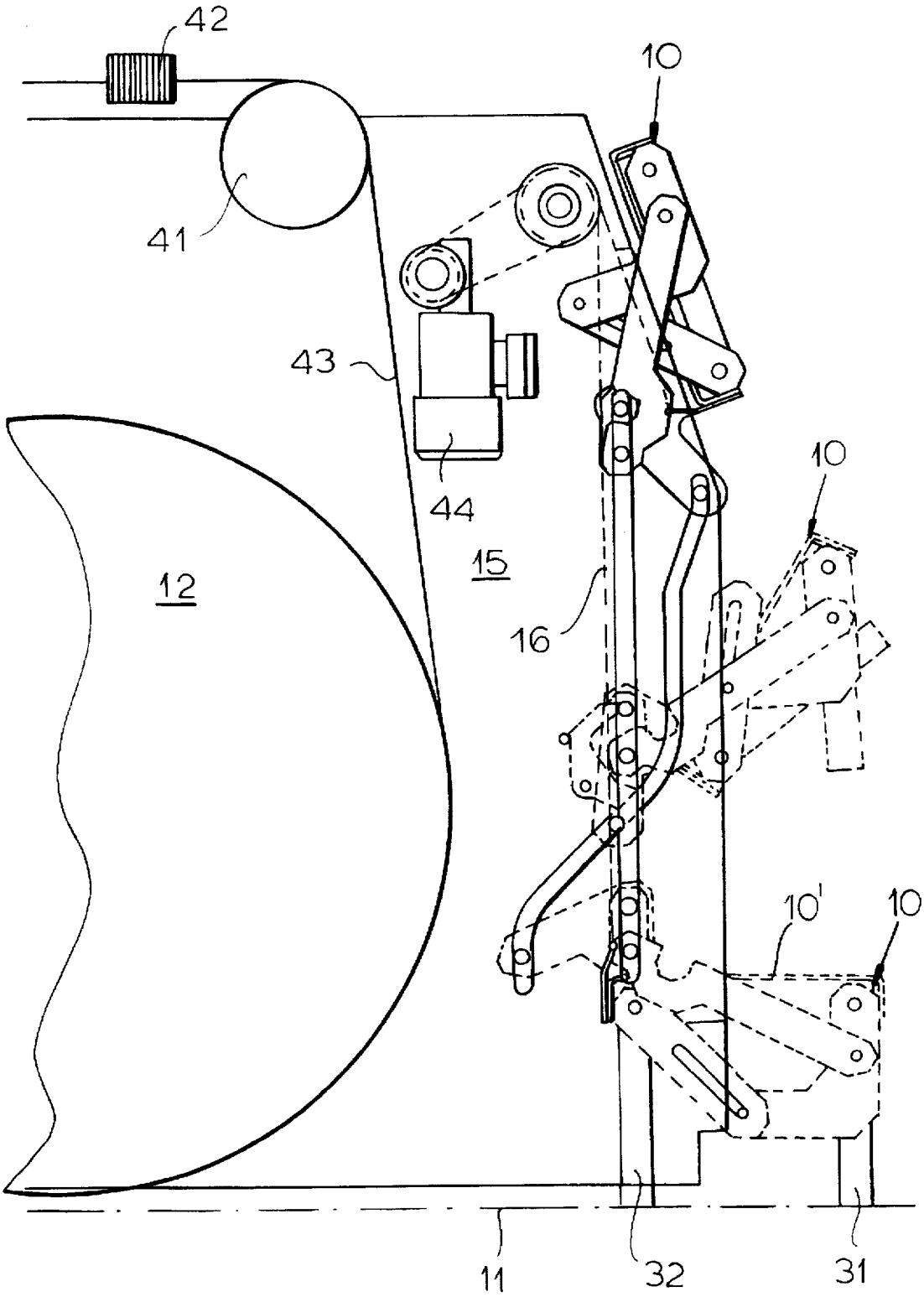
FIG. 2 is a large-scale view of a detail of FIG. 1 showing the step in three different positions.

As seen in FIG. 1 a warp beamer has a frame 15 on which a warp beam 12 is supported for rotation about a horizontal axis 12A by a motor 14. The frame 15 is comprises of two vertical end plates between which the beam 12 is supported. A warp 43 passes horizontally from a creel through a comb 42 and then is deflected over a horizontal roller 41 at the top of the frame 15 so that it can be wound up on the warp beam 12.

A step 10 having a planar step surface 10' that is horizontal in the FIG. 1 lower position serves for supporting a machine operator 13 who needs the step 10 so that he or she can reach the warp 43 at the top of the machine. The step 10 is vertically movable by a motor 44 that is connected via a worm drive 46 and belt 47 to a take-up roller 45 rotatable about a horizontal axis at the top of the machine and connected to an upper edge of a flexible screen 16 whose lower edge is connected to the step 10. The roller 45 and screen 16 extend the full length of the machine so that when the screen 16 is down as shown in FIG. 1 it shields the warp 43 and beam 12 and not only is the warp 43 protected but so is the operator 13 of the machine.

As better shown in FIGS. 2 through 5, the frame 15 has on each side a pair of guide slots 17 and 18. The first slot 17 is perfectly vertical and is normally quite deep. The second guide slot 18 is shallower and has a vertical lower end portion 48 inward of the guide slot 17, an angled portion 25 crossing the slot 17, another straight and vertical portion 26 outward of the guide slot 17, and an outwardly angled upper end portion 27. A short follower pin 20 rides in the slot 18 while long follower pins 19 and 51 ride in the slot 18. These pins 19, 20, and 51 are dimensioned to fit in the respective slots 17 and 18, with the pins 19 and 51 much longer than the pin 20 to prevent them from moving from the one slot 17 to the other.

In addition a gate lever 28 is provided that has a short arm 29 with an end surface 29' that can block (see FIG. 5) entry into the slot 17 above where it crosses the slot 18, and a long arm 31 that can project across the slot 18 to allow it to be flipped back and forth between a position (FIGS. 1, 2, and 3) resting against an abutment pin 49 fixed on the frame 1 with the arm 30 crossing the slot 17 and a position (FIGS. 4 and 5) with the surface 29' blocking the slot 17 and the arm 30 pivoted back out of the path of the pins 19 and 51 in the slot 17.

A main V-shaped guide lever 21 has a center 24 carrying the pin 19 riding in the guide slot 17, an inner arm 22 carrying the pin 20 riding in the slot 18, and an outer arm 23 fixed to the inner end of the step 10. The lower end of the flexible mesh entrainment element 16 is fixed to the inner end of the step 10 so that as same is lifted the lever 21 is pivoted counterclockwise about the pin 19, thereby pivoting out the inner end of the step 10 and pivoting up the step 10 until it is swung through about 110° as the pin 20 moves into the angled upper portion 27 of the guide slot 18.

Figure 3:
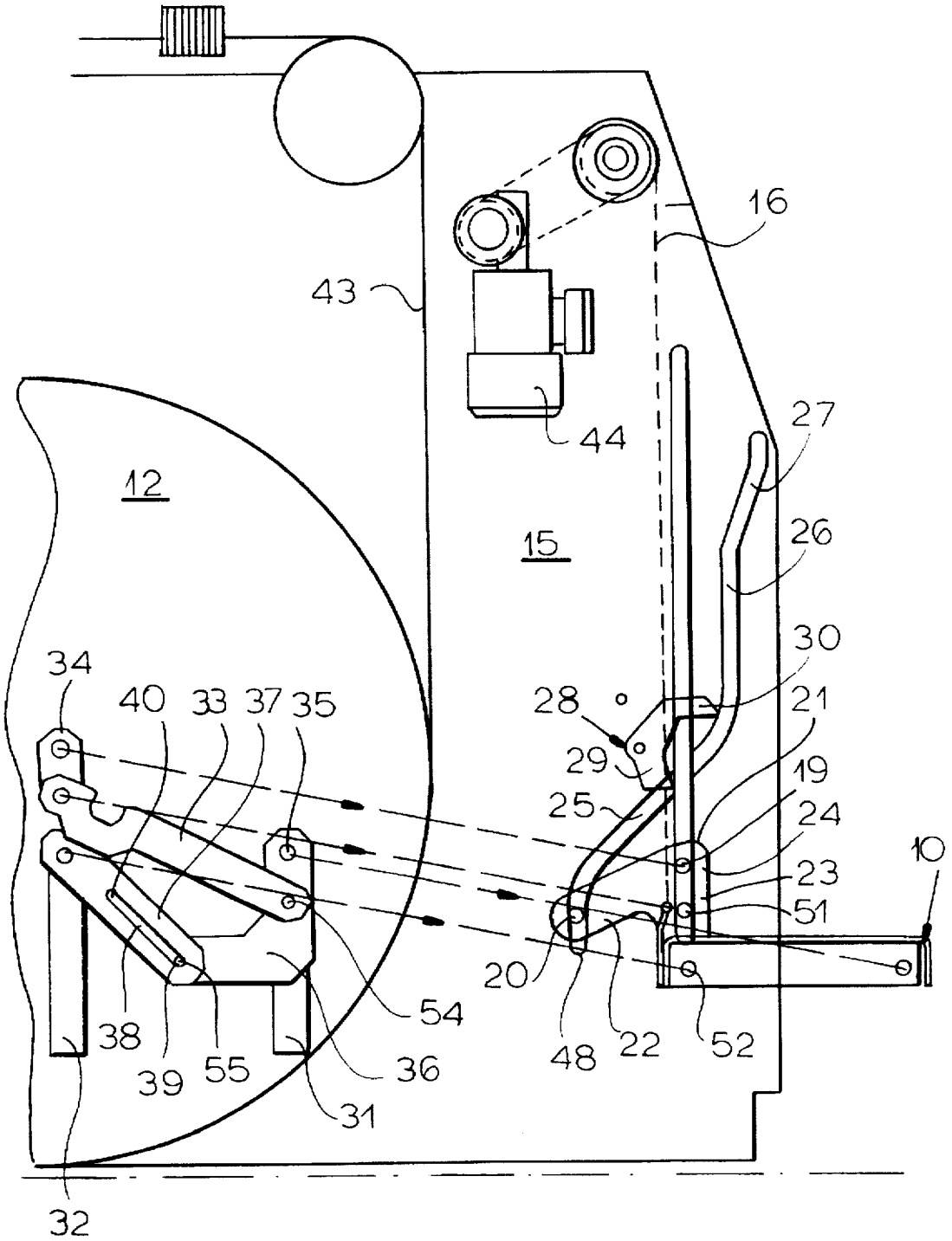
FIGS. 3, 4, and 5 are views like FIG. 2 but showing the warp beam in the lower, intermediate, and upper positions, respectively, with the lever assembly shown offset for clarity of view.
Figure 4:
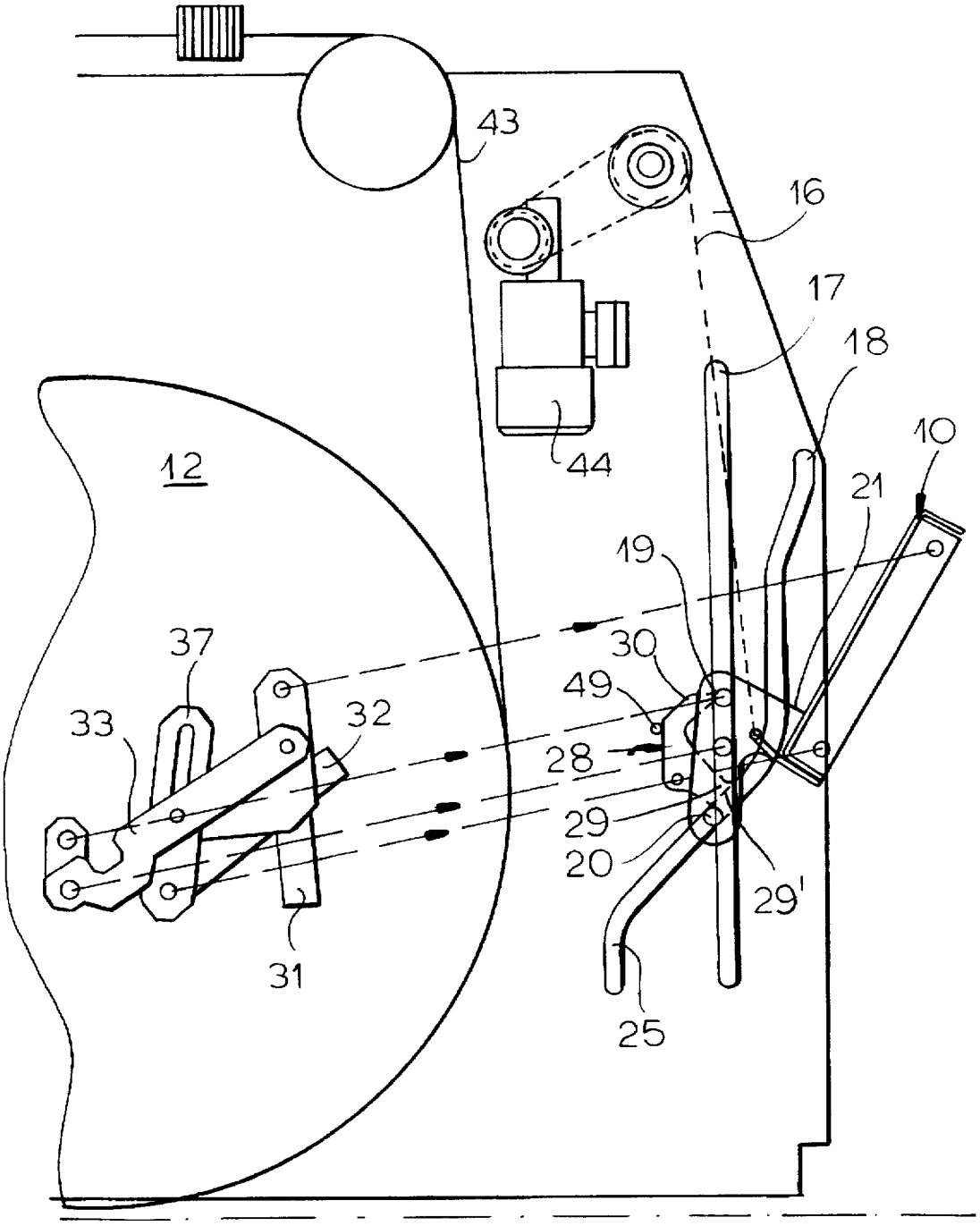
Figure 5:
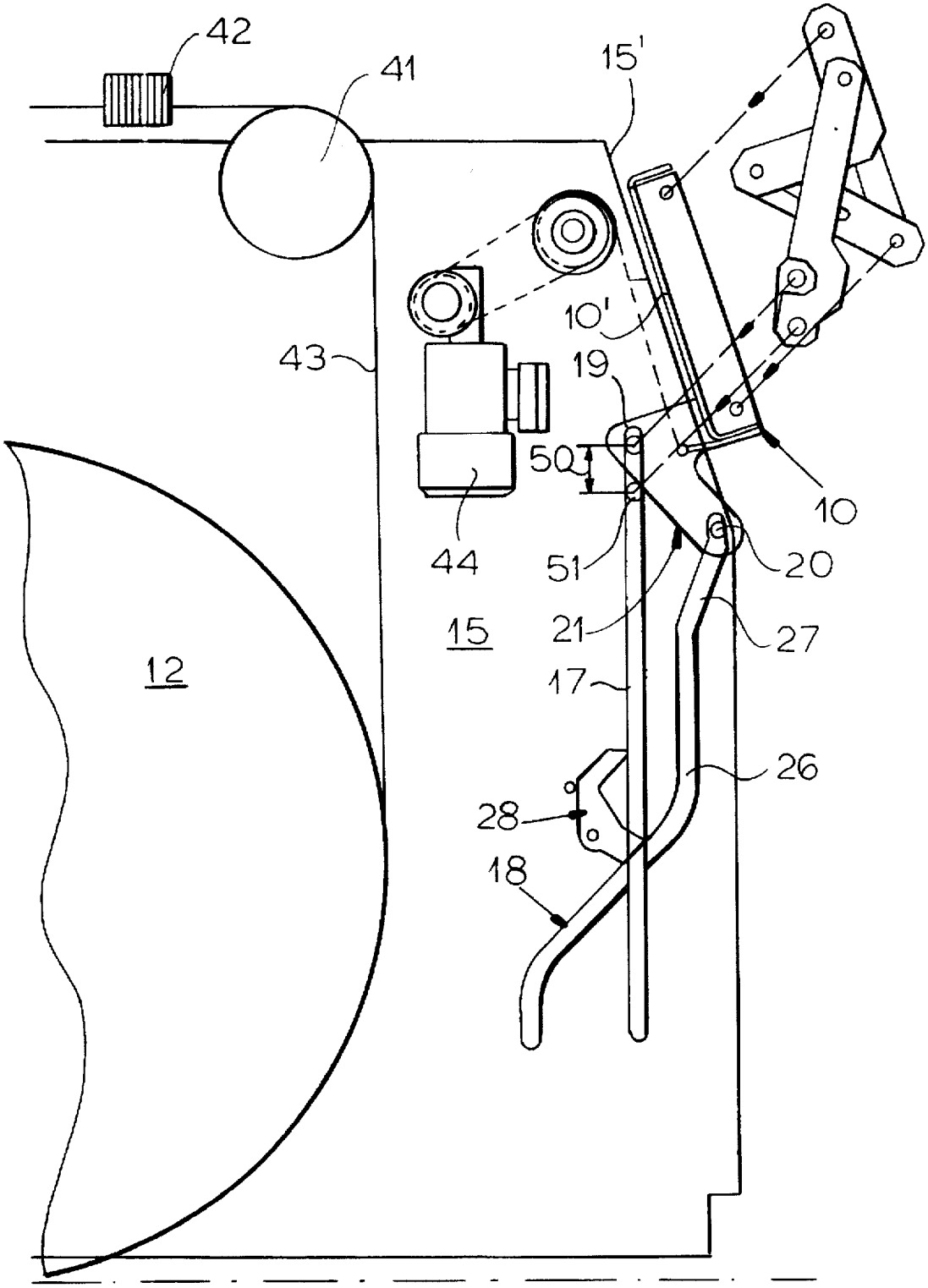

The step 10 is supported on at least two identical lever assemblies shown offset from their actual locations in FIGS. 3, 4, and 5 for clarity of view. Each lever assembly comprises an outer foot 31 pivoted at 35 on the outer end of the step 10 and fixed to an L-shaped lever 36 and an inner foot 32 pivoted at 52 on the inner end of the step 10 and fixed to a lever 37. A link 34 has its upper end pivoted on the pin 19 and a lower end carrying the pivot pin 51 where it is pivoted to a coupling link 33 whose opposite end is pivoted at a location 54 on the leg 31 and lever 36 somewhat below the pivot 35. The pins 34 and 51 are spaced by a distance 50 that is somewhat less than the spacing between the pivots 35 and 54 so that as the step 10 is pivoted over into the upper position of FIG. 5 lying parallel to angled edges 15' of the frame 15 the mechanism does not bind. A pin 55 on the inner end of the lever 36 rides in a slot 38 formed in the lever 37 so that as it moves from an outer end 39 to an inner end 40 of this slot 38 the legs 31 and 32 are pivoted together to lie flatly inside the hollow bottom of the step 10.

The system described above functions as follows:

As the motor 44 starts to reel in the screen 16 at first the step 10 rises perfectly vertically as the pin 20 travels along the straight portion 48 of the guide 18. Once the pin 20 enters the angled portion 25 of the guide 18 the lever 21 and step 10 are pivoted up as shown in FIG. 4. At the same time the legs 31 and 32 are pivoted in by the links 33 and 37. As the pin 19 engages the arm 30 of the gate lever 28 it pivots it up so that its surface 29' closes the guide 17 to prevent the pin 20 from entering the slot 17 as this pin 20 moves up, which action takes place after the pin 51 has crossed the slot 18. No protection is needed to prevent the pins 19 and 51 from entering the groove 18 as these pins 19 and 51 are too long to be accommodated in this shallow structure.

The step 10 continues to pivot inward and the legs 31 and 32 are folded into it as the pins 19 and 51 continue to travel up in the guide 17 and then back to the upper position of FIG. 5. In this position the entire front of the machine is clear so that the full beam 12 can be moved out and an empty beam can be moved in. Once an empty beam is in position on the axis 12A, the motor 44 is reversed so that the step 10 moves down, mainly by gravity, to reassume the position of FIG. 1. On the way back down the pin 51 flips down the lever 28 to allow the pins 19 and 51 to move across the slot 18 into the lower part of the slot 17, which action takes place after the pin 20 has crossed the slot 17.

Normally a controller 53 connected to the motor 14 that rotates the beam 12 and to the motor 44 that raises and lowers the step 10 automatically energizes the motor 44 when the warp beam's rotation is stopped. In addition it automatically lowers the step 10 to the lower use position when or before the beam 12 is started rotating again.

We claim:

1. In combination with a warp beamer having a frame supported on the floor and a horizontal warp beam rotatable on the frame, a step assembly comprising:

a step displaceable between a lower position supported directly on the floor and an upper position spaced well above the floor and of the warp beam; and means connected between the step and the frame and including a motor for displacing the step between its positions.

2. The step assembly defined in claim 1 wherein the displacing means includes:

a vertical guide on the frame in which the step rides; and means including a lever assembly for pivoting the step between a horizontal position in the lower position and a generally vertical position in the upper position.

3. The step assembly defined in claim 2 wherein the frame has a pair of ends flanking the warp beam and each provided with at least one such guide in which the step rides.

4. The step assembly defined in claim 2 wherein the displacing means includes at least one flexible element having one end operatively connected to the motor and an opposite end connected to the step.

5. The step assembly defined in claim 4 wherein the displacing means includes a horizontally elongated roller driven by the motor, above the warp beam, and attached to the one end of the element, the element being a flexible sheet extending generally a full length of the roller and warp beam.

6. The step assembly defined in claim 2 wherein the frame is formed with at least two such guides and the step has respective followers engaged in the guides.

7. The step assembly defined in claim 6 wherein the lever assembly includes a lever fixed to the step and carrying both of the followers, one of the guides extending at least partially at an acute angle to the other of the guides.

8. The step assembly defined in claim 7 wherein the one guide crosses the other guide.

9. The step assembly defined in claim 8 wherein the other guide is substantially straight and vertical.

10. The step assembly defined in claim 9 wherein the one guide has a straight and vertical end portion to one side of the other guide, an angled portion extending across the other guide, another straight and vertical portion to the other side of the other guide, and an angled end portion to the other side of the other guide.

11. The step assembly defined in claim 9 wherein the guides are both grooves and the other guide is substantially deeper than the one guide.

12. The step assembly defined in claim 11, further comprising gate means for closing the other guide after movement of the respective follower vertically up past the one guide.

13. The step assembly defined in claim 12 wherein the gate means is a two arm lever pivoted adjacent the other guide and having a surface positionable across a mouth where the other guide opens into the one guide.

14. The step assembly defined in claim 13 wherein the gate-means lever is engageable with the follower of the other guide.

15. The step assembly defined in claim 2 wherein the step is provided with feet engageable in an extended position with the floor in the lower position and foldable flat in a stowed position against the seat in the upper position.

16. The step assembly defined in claim 15 wherein the feet are pivotal on the step and provided with lever means for automatically displacing them between the extended and stowed positions on movement of the step between the lower and upper positions.

17. The step assembly defined in claim 16 wherein the lever means includes interlinked levers fixed to the feet and an actuating lever connected to one of the feet.

18. The step assembly defined in claim 17 wherein one of the interlinked levers is fixed to one of the feet and has a follower riding in the guide.

19. The step assembly defined in claim 16 wherein one of the interlinked levers is formed with a slot and the other of the interlinked levers has a pin slidable along the slot.

20. The step assembly defined in claim 1, further comprising drive means for rotating the warp beam about a horizontal axis; and means connected between the drive means and the motor for moving the step into the upper position when the drive means stops rotating the warp beam.

* * * * *